United States Patent [19]

Yoshimura et al.

[11] Patent Number: 4,587,174

[45] Date of Patent: May 6, 1986

[54] TUNGSTEN CERMET

[75] Inventors: Hironori Yoshimura; Naohisa Ito, both of Tokyo; Kenichi Nishigaki; Katsunori Anzai, both of Omiya, all of Japan

[73] Assignee: Mitsubishi Kinzoku Kabushiki Kaisha, Tokyo, Japan

[21] Appl. No.: 564,958

[22] Filed: Dec. 23, 1983

[30] Foreign Application Priority Data

Dec. 24, 1982 [JP] Japan ..... 57-230408
Dec. 24, 1982 [JP] Japan ..... 57-230409

[51] Int. Cl.[4] ..... C22C 29/04; C22C 29/14

[52] U.S. Cl. ..... 428/552; 75/233; 75/235; 75/238; 75/248; 419/13; 419/15; 428/551

[58] Field of Search ..... 75/235, 233, 238, 248; 428/551, 552; 419/15, 13

[56] References Cited

U.S. PATENT DOCUMENTS 4,447,263 5/1984 Sugizawa et al. ..... 75/233

*Primary Examiner*—Allan M. Lieberman
*Attorney, Agent, or Firm*—Cushman, Darby & Cushman

[57] ABSTRACT

A tungsten cermet for use in cutting tools, including a carbonitride, having titanium and tungsten, and aluminum oxide. The cermet contains about 10 to about 50% by weight of the carbonitride, about 0.5 to about 10% by weight of aluminum oxide and tungsten as a binder. The tungsten cermet has excellent properties in toughness, impact resistance and oxidation resistance, combined with wear resistance and plastic deformation resistance, and is useful for cutting tools used in heavy cutting, hot working and the like.

12 Claims, No Drawings

TUNGSTEN CERMET

The present invention relates to a tungsten cermet which has high strength and hardness, and is excellent in wear resistance, plastic deformation resistance and impact resistance. The tungsten cermet according to the present invention therefore exhibits excellent performances in use where such properties are required, for instance, cutting tools used in high speed cutting, heavy cutting such as cutting with large feed per revolution or with large depth of cut, and hot working tools such as hot reduction roll, hot wiredrawing roll, hot press die, hot forging die and hot extrusion punch.

Heretofore, there was proposed a cermet including a hard phase composed of a carbonitride of titanium and tungsten (hereinafter referred to as "(Ti, W)C,N") and a binder phase composed of W-Mo alloy. In this prior art cermet, grain growth of tungsten and (Ti, W)C,N as the constituent elements occurs since the cermet must be sintered above 2000° C., and it is hence relatively low in toughness and oxidation resistance. For this reason the prior art cermet cannot be used in heavy cutting and high speed cutting of steel and the like in which toughness, impact resistance and oxidation resistance are required.

The inventors have studied the prior art cermet, which is excellent in wear resistance and thermoplastic deformation resistance, to improve toughness, impact resistance and oxidation resistance, and unexpectedly found a tungsten cermet for use in cutting tools, including a carbonitride having titanium and tungsten, the cermet consisting essentially of about 10 to about 50% by weight of the carbonitride, about 0.5 to about 10% by weight of aluminum oxide and tungsten as a binder. In this cermet a complete sinter is obtained at relatively low temperatures since aluminum oxide as the hard phase promote sintering, and such low temperature sintering not merely prevents (Ti, W)C,N and tungsten from grain growth but results in a microstructure of those elements which largely improves the cermet in toughness, impact resistance and oxidation resistance. Accordingly, the cermet according to the present invention has excellent properties in strength, hardness, wear resistance and plastic deformation resistance, combined with high toughness, impact resistance and oxidation resistance.

As the major hard phase constituent element, about 10 to about 50% by weight of (Ti, W)C,N is required in the present invention. This element provides the cermet with wear resistance. It is also excellent in high temperature characteristics. However, with less than about 10% by weight of (Ti, W)CN, the (Ti, W)CN phase is homogeneously dispersed in the tungsten matrix without forming any skeleton, and hence the intended wearing resistance and plastic deformation resistance cannot be obtained. On the other hand, with more than about 50% the tungsten matrix is formed in an excessively small amount, which results in insufficient toughness of the finished product. The best results are obtained by the use of about 25 to about 45% by weight of (Ti, W)C,N.

The concentration of aluminum oxide according to the present invention must be in the range of about 0.5 to about 10% by weight and preferably in the range of about 3 to about 7% by weight. The aluminum oxide is homogeneously dispersed in the tungsten matrix to thereby promote sintering and prevent grain growth in the hard and binder phases. Thus, the finished cermet is improved in toughness, impact resistance and oxidation resistance. However, with less than about 0.5% by weight of aluminum oxide, such desired properties cannot be obtained, and with more than about 10% by weight of aluminum oxide, plastic deformation resistance of the cermet is degraded.

Table 1 below shows permissible concentration ranges and best results ranges of the components used in the present invention.

TABLE 1

| Component Used | Percent by Weight | |
|---|---|---|
| | Permissible | For Best Results |
| (Ti, W) C, N | 10–50 | 25–45 |
| $Al_2O_3$ | 0.5–10 | 3–7 |
| W | The rest (40–89.5) | The rest (48–72) |

The cermet according to the present invention may further contain yttrium oxide, in which case the cermet must contain from about 0.25 to about 5% by weight of yttria and from about 0.25 to about 5% by weight of aluminum oxide. The yttrium oxide and the aluminum oxide are homogeneously dispersed in the tungsten matrix to thereby promote sintering and prevent grain growth in the hard and binder phases with the result that the finished product is improved in toughness, impact resistance and oxidation resistance. The aluminum oxide and the yttrium oxide each should be present in the finished cermet in an amount of at least about 0.25% by weight since lower amounts do not provide such improved properties. On the other hand, amounts in excess of about 5% by weight deteriorates the cermet in plastic deformation resistance. The best results are obtained when the cermet contains from about 2 to about 3.5% by weight of aluminum oxide and from about 1.5 to about 3% by weight of yttrium oxide.

Table 2 below shows permissible concentration ranges and best results ranges of the components used in the present invention when yttrium oxide is used.

TABLE 2

| Component Used | Percents by weight | |
|---|---|---|
| | Permissible | For Best Results |
| (Ti, W) C, N | 10–50 | 25–45 |
| $Al_2O_3$ | 0.25–5 | 2–3.5 |
| $Y_2O_3$ | 0.25–5 | 1.5–3 |
| W | The rest (40–89.5) | The rest (48.5–71.5) |

In the present invention, although part of tungsten contained in the cermet is dissolved into the hard phase, the larger part of the tungsten exists as the binder phase and strongly adhered to the hard phase to thereby provide the cermet with excellent toughness and impact resistance in cooperation with aluminum oxide.

The tungsten cermet according to the present invention may contain not more than about 1% by weight of inevitable impurities such as Mo, Cr, Fe, Ni, Co and Re. Such impurities in an amount of not more than about 1 weight percent do not adversely affect the properties of the cermet according to the present invention.

In producing the tungsten cermet according to the present invention, after matching powders of (Ti, W)C,N, aluminum oxide and tungsten in predetermined compositions within the ranges mentioned above, the matched material is wet mixed and then dried in a conventional manner. Thereafter, it is molded into a green compact, which is then sintered within a temperature range of from about 1800° C. to about 2500° C. in a vacuum or in an atmosphere of argon or nitrogen gas of atmospheric pressure to produce a cermet with intended properties. Alternatively, the matched and dried material may be subjected to hot hydrostatic pressing in an atmosphere of argon or nitrogen gas within a pressure range of about 1000 to about 2000 atm and within a temperature range of about 1600° C. to about 2000° C.

The cermet thus produced according to the present invention is machined into a tip or an insert blade, which may be coated in a well-known manner such as chemical vapor deposition or physical vapor deposition. The coating may include one layer composed of one of a carbide, nitride, carbonitride and nitrocarbon oxide of titanium, zirconium or hafnium or more than one layers composed of at least two of those substances. The coating may otherwise be one layer of an oxide and an oxynitride of aluminum or more than one layers of those substances. The tip or insert thus coated exhibits more excellent wear resistance when used in cutting tools for high speed cutting and heavy cutting of steel or cast iron since the cutting edge thereof is not subjected to plastic deformation at high temperatures during cutting, thus having high hardness and excellent chemical stability, and since the coating layer or layers are strongly adhered to the substrate. The average thickness of the coating is preferably within a range of about 0.5 to about 20 μm. With a coating of a thickness less than about 0.5μ, sufficient wearing resistance cannot be obtained, and on the other hand with a coating of a thickness larger than about 20 μm, the coated tool exhibits a large degradation in toughness.

The invention will be described in more detail with reference to the following examples, in which specific carbonitrides of titanium and tungsten were represented as $(Ti_a, W_b)C_xN_y$ wherein a, b, x and y represent the atomic ratios respectively and wherein a+b=1 and x+y=1.

EXAMPLE 1

A powder of a complete solid solution $(Ti_{0.85}W_{0.15})(C_{0.70}N_{0.30})$, having an average particle size of 1.5 μm, $Al_2O_3$ powder of an average particle size of 0.5 μm and a tungsten powder of an average particle size of 0.8 μm were mixed in compositions set forth in TABLE 3 by a wet ball mill for 72 hours. After being dried each mixture was subjected to compacting at a pressure of 15 Kg/mm² to form a green compact, which was sintered in an atmosphere of nitrogen gas of 760 Torr at a temperature of 2000° to 2300° C. for two hours to produce each of cermets 1–5 according to the present invention and comparative cermets 1 and 2, each being of substantially the same composition as described in TABLE 3.

Subsequently, the cermets thus obtained were tested as to Rockwell "A" hardness and transverse rupture strength (hereinafter referred to as T.R.S.), and formed into cutting tool inserts having a standard SNG 433 shape. The inserts were each attached to a holder and then subjected to a high speed continuous cutting test and an intermittent cutting test on the conditions indicated in TABLE 4. In the high speed continuous cutting test, flank wear width and crater wear depth of each tested insert were measured, and in the intermittent cutting test the number of largely chipped inserts out of ten inserts of the same composition was counted. The results are tabulated in TABLE 3. For comparison purposes, cemented tungsten carbide alloy inserts of P10 grade in ISO (hereinafter referred to as conventional inserts 1) and cutting inserts made of a cermet of TiC—10 wt.% Mo—15 wt.% Ni (hereinafter referred to as conventional insert 2) were subjected to the above-mentioned cutting tests on the same conditions. The results are also set forth in TABLE 3.

TABLE 3

| | | Blend Composition (% by weight) | | | Hardness | T.R.S. | High Speed Continuous Cutting Test | | Intermittent Cutting Test Number of |
|---|---|---|---|---|---|---|---|---|---|
| | | (Ti, W).C,N | $Al_2O_3$ | W | ($H_RA$) | (kg/mm²) | Flank Wear Width (mm) | Crater Depth (μm) | Largely Chipped Tools/Number of Tested Tools |
| Cermet of the present invention | 1 | 40.0 | 0.5 | 59.5 | 91.5 | 87 | 0.16 | 80 | 4/10 |
| | 2 | 40.0 | 1.0 | 59.0 | 91.5 | 95 | 0.15 | 50 | 2/10 |
| | 3 | 40.5 | 3.0 | 56.5 | 91.3 | 106 | 0.15 | 35 | 1/10 |
| | 4 | 41.0 | 5.0 | 54.0 | 91.0 | 110 | 0.17 | 30 | 0/10 |
| | 5 | 48.0 | 3.0 | 49.0 | 91.7 | 86 | 0.13 | 25 | 3/10 |
| Comparative Cermet | 1 | 40.0 | —* | 60.0 | 90.0 | 52 | largely chipped in 7 min. | | 9/10 |
| | 2 | 54.5* | 5.0 | 40.5 | 91.6 | 62 | 0.11 | 30 | 9/10 |
| Conventional Inserts | 1 | Cemented Tungsten Carbide Alloy(P10) | | | — | — | 0.52 | 150 | 9/10 |
| | 2 | TiC—10% Mo—15% Ni | | | — | — | 0.40 | 80 | 10/10 |

*not fallen within the scope of the invention

TABLE 4

| | High speed continuous cutting test | Intermittent cutting test |
|---|---|---|
| Work | AISI 4130 Brinell hardness $H_B$:240 | AISI 4130 Brinell hardness $H_B$:270 |
| Cutting speed (m/min.) | 200 | 120 |
| Feed (mm/rev.) | 0.3 | 0.4 |
| Depth of cut (mm) | 2 | 3 |
| Cutting time (min.) | 10 | 3 |

As clearly seen from TABLE 3, the cermets 1–5 produced according to the present invention exhibited excellent properties in hardness and toughness and also exhibited excellent wear resistance and impact resistance in both the cutting tests. In contrast, with respect to the comparative cermet 1 free of $Al_2O_3$ it was noted that in the high speed continuous cutting test a large chipping was produced at its edge and it could not perform cutting in seven minutes by rapid development in grooving wear and crater wear due to inferior oxidation resistance, and it was further noted that in the intermittent cutting test large chippings were produced in most of the inserts because of lack of sufficient toughness. With respect to the comparative cermet 2 which is larger in concentration of (Ti, W)C,N than the present invention, it was noted that although the inserts exhibited excellent wear resistance, in the intermittent cutting test large chippings were produced in most of them due to inferior toughness or impact resistance. Further, it was clearly noted that the conventional inserts 1 and 2 were inferior in both the wear resistance and toughness (impact resistance) to the present invention.

TABLE 5A

| | | Blend Composition (% by weight) | | | | | | |
|---|---|---|---|---|---|---|---|---|
| | | $(Ti_{0.75}W_{0.25})\cdot(C_{0.8}N_{0.2})$ | $(Ti_{0.85}W_{0.15})\cdot(C_{0.7}N_{0.3})$ | $(Ti_{0.7}W_{0.3})\cdot(C_{0.7}N_{0.3})$ | $(Ti_{0.8}W_{0.2})\cdot(C_{0.6}N_{0.4})$ | $Al_2O_3$ | W | Atmosphere in Sintering |
| Cermet of the Present Invention | 6 | 35.0 | — | — | — | 5.0 | 60.5 | Nitrogen Gas of 300 Torr |
| | 7 | — | 30.0 | — | — | 5.0 | 65.0 | Nitrogen Gas of 400 Torr |
| | 8 | — | — | 35.0 | — | 5.0 | 60.0 | Nitrogen Gas of 500 Torr |
| | 9 | — | — | — | 30.0 | 3.0 | 67.0 | Nitrogen Gas of 600 Torr |
| | 10 | 17.5 | — | — | 15.0 | 5.0 | 62.5 | Vacuum of $1 \times 10^{-2}$ Torr |
| | 11 | — | 15.0 | 17.5 | — | 5.0 | 62.5 | Vacuum of $1 \times 10^{-2}$ Torr |
| | 12 | 30.0 | — | — | — | 4.5 | 65.5 | Argon Gas of 400 Torr |
| | 13 | — | 27.5 | — | — | 4.5 | 68.0 | Argon Gas of 400 Torr |
| | 14 | — | — | 30.0 | — | 4.5 | 65.5 | Argon Gas of 400 Torr |
| | 15 | — | — | — | 27.5 | 3.0 | 69.5 | Argon Gas of 400 Torr |
| | 16 | 15.0 | — | — | 15.0 | 4.5 | 65.5 | Vacuum of $1 \times 10^{-2}$ Torr |
| Conventional Inserts | 3 | Cemented Tungsten Carbide Alloy (P30) | | | | | | — |

TABLE 5B

| | | Hardness ($H_RA$) | T.R.S. ($kg/mm^2$) | High Feed Continuous Cutting: Flank Wear Width (mm) | High Feed Continuous Cutting: Crater Depth (μm) | Intermittent Cutting Number of Largely Chipped Tools/ Number of Tested Tools |
|---|---|---|---|---|---|---|
| Cermet of the present invention | 6 | 90.1 | 118 | 0.16 | 40 | 2/10 |
| | 7 | 90.0 | 120 | 0.14 | 35 | 1/10 |
| | 8 | 90.0 | 121 | 0.14 | 40 | 0/10 |
| | 9 | 89.8 | 117 | 0.18 | 30 | 2/10 |
| | 10 | 90.0 | 118 | 0.17 | 35 | 2/10 |
| | 11 | 90.0 | 120 | 0.14 | 35 | 1/10 |
| | 12 | 90.0 | 122 | 0.18 | 45 | 1/10 |
| | 13 | 89.9 | 122 | 0.17 | 45 | 1/10 |
| | 14 | 89.7 | 125 | 0.16 | 45 | 0/10 |
| | 15 | 89.7 | 115 | 0.19 | 40 | 2/10 |
| | 16 | 89.9 | 116 | 0.18 | 45 | 2/10 |
| Conventional Inserts | 3 | — | — | Plastic deformation in 3 min. | | 3/10 |

EXAMPLE 2

In addition to the powders as used in Example 1, a $(Ti_{0.75}W_{0.25})(C_{0.80}N_{0.20})$ powder having an averge particle size of 1.5 μm, a $(Ti_{0.70}W_{0.30})(C_{0.70}N_{0.30})$ powder having an average particle size of 1.8 μm and a $(Ti_{0.80}W_{0.20})(C_{0.80}N_{0.20})$ powder having an averge particle size of 2.0 μm were prepared, all the carbonitrides being in complete solid solution, and on the same conditions as in Example 1 these poders were mixed with other components in blend compositions shown in TABLE 5A and then pressed to form green compacts, which were each sintered in the atmosphere shown in TABLE 5A at a temperature of 2000° C. for two hours to thereby produce each of cermets 6–16 covered by the appended claims, which had substantially the same composition as the blend composition.

The cermets thus obtained were each subjected to the Rockwell "A" hardness test and the T.R.S. test, and formed into cutting tool inserts having a standard SNG 433 shape. The inserts were each attached to a holder and then subjected to a continuous cutting test 2 with a high feed per revolution and an intermittent cutting test 2 on the conditions given in TABLE 6. The results are set forth in TABLE 5B. Furthermore, cemented tungsten carbide cutting inserts of ISO P30 grade (conventional insert 3) were subjected to the same tests, the results of which are also tabulated in TABLE 5B.

TABLE 6

| | Continuous cutting test 2 | Intermittent cutting test 2 |
|---|---|---|
| Work | AISI 4130 Brinell Hardness $H_B$:260 | AISI 4130 Brinell Hardness $H_B$:270 |
| Cutting speed (m/min.) | 100 | 100 |

TABLE 6-continued

| | Continuous cutting test 2 | Intermittent cutting test 2 |
|---|---|---|
| Feed (mm/rev.) | 0.8 | 0.45 |
| Depth of cut (mm) | 4 | 3 |
| Cutting time (min.) | 10 | 3 |

It is clear from TABLE 5B that all the cermets according to the present invention had high hardness and high toughness, and exhibited excellent cutting performances in both the high feed continuous cutting test 2 and the intermittent cutting test. On the other hand, the conventional inserts 3 could not perform cutting in three minutes in the continuous cutting test 2 due to inferior plastic deformation resistance although it was substantially equal to the cermets of the present invention in toughness or impact resistance.

EXAMPLE 3

In addition to the $Al_2O_3$ powder and tungsten powder as used in Examples 1, there were prepared a powder of complete solid solution $(Ti_{0.80}W_{0.20})(C_{0.70}N_{0.30})$ of 1.5 μm average particle size, a molybdenum powder of 0.8 μm average particle size, a nickel powder of 2.5 μm average particle size, cobalt powder of 1.2 μm average particle size and a rhenium powder of 3.0 μm average particle size. These powders were mixed in compositions given in TABLE 7A, dried and pressed on the same conditions as in the Example 1 to form compacts, which were then each sintered under an atmosphere of nitrogen gas of 300 Torr at a temperature shown in TABLE 7A for two hours to thereby produce each of cermets 17–25 of the present invention and comparative cermets 3–5.

These cermets were subjected to the same tests as in Example 2 except that the continuous cutting test and the intermittent cutting test were conducted on the conditions given in TABLE 7C. The results are tabulated in TABLE 7B.

On the other hand, conventional insert 4 made of a cemented tungsten carbide alloy of ISO P40 grade were prepared and subjected to the same cutting tests as in Example 3 for comparison purposes, of which results are also shown in TABLE 7B.

From TABLE 7B it is clear that the cermets 17–25 according to the present invention were excellent in hardness and toughness and exhibited excellent cutting performances in both the continuous cutting test and the intermittent cutting test. Further, the cermets 22–25 show that any concentration of not larger than about 1% of impurities such as Mo, Ni, Co or Re did not adversely affect the properties of the cermets of the present invention. In contrast, the lack of toughness and poor cutting performances were noted in the comparative cermet 3 containing $Al_2O_3$ beyond the upper limit concentration recited in the appended claims, the comparative cermet 4 containing (Ti, W)C,N below the lower limit concentration defined in the appended claims and the comparative cermet 5 containing more than about 1% by weight of nickel as an impurity. With respect to the conventional insert 4, it was noted that in the continuous cutting test it was unable to cut the work in 0.5 min. due to inferior plastic deformation resistance although it was equal in toughness or impact resistance to the cermets 17–25 according to the present invention.

TABLE 7A

| | | Blend Composition (% by weight) | | | | Sintering |
|---|---|---|---|---|---|---|
| | | $(Ti_{0.8}W_{0.2})$. $(C_{0.7}N_{0.3})$ | $Al_2O_3$ | W | Impurity | Temperature (°C.) |
| Cerment of the Present Invention | 17 | 30.0 | 5.0 | 65.0 | — | 2000 |
| | 18 | 25.0 | 5.0 | 70.0 | — | 2000 |
| | 19 | 20.0 | 7.0 | 73.0 | — | 2000 |
| | 20 | 15.0 | 7.0 | 78.0 | — | 2200 |
| | 21 | 10.0 | 9.0 | 81.0 | — | 2200 |
| | 22 | 25.0 | 5.0 | 69.0 | Mo:1.0 | 2000 |
| | 23 | 25.0 | 5.0 | 69.2 | Ni:0.8 | 2000 |
| | 24 | 25.0 | 5.0 | 69.3 | Co:0.7 | 2000 |
| | 25 | 25.0 | 5.0 | 69.5 | Re:0.5 | 2000 |
| Comparative Cermet | 3 | 10.0 | 11.0* | 79.0 | — | 2200 |
| | 4 | 8.5* | 5.0 | 86.5 | — | 2200 |
| | 5 | 25.0 | 5.0 | 67.5 | Ni:2.5* | 1800 |
| Convention Inserts | 4 | Cemented Tungsten Carbide Alloy (P 40) | | | | — |

*not fallen within the scope of the present invention

TABLE 7B

| | | Hardness ($H_RA$) | T.R.S. ($kg/mm^2$) | High Feed Continuous Cutting: Width of Flank Wear (mm) | High Feed Continuous Cutting: Crater Depth (μm) | Intermittent Cutting: Number of Largely Chipped Tools/Number of Tested Tools |
|---|---|---|---|---|---|---|
| Cermet of the Present Invention | 17 | 89.0 | 120 | 0.15 | 30 | 1/10 |
| | 18 | 88.8 | 121 | 0.16 | 35 | 1/10 |
| | 19 | 88.6 | 122 | 0.18 | 35 | 1/10 |
| | 20 | 88.4 | 122 | 0.20 | 40 | 2/10 |
| | 21 | 87.9 | 111 | 0.26 | 45 | 3/10 |
| | 22 | 88.5 | 110 | 0.19 | 45 | 3/10 |
| | 23 | 88.3 | 115 | 0.20 | 50 | 2/10 |
| | 24 | 88.3 | 113 | 0.20 | 50 | 2/10 |
| | 25 | 88.6 | 120 | 0.18 | 40 | 1/10 |
| Comparative Cerment | 3 | 87.7 | 57 | Plastic Deformation in 2 min. | | 9/10 |
| | 4 | 87.0 | 52 | Plastic Deformation in 1.5 min. | | 9/10 |
| | 5 | 87.2 | 63 | Plastic Deformation in 0.9 min. | | 9/10 |
| Conventional Inserts | 4 | — | — | Plastic Deformation in 0.5 min. | | 2/10 |

TABLE 7C

| | Continuous Cutting Test 3 Under Large Feed Per Revolution | Intermittent Cutting Test 3 |
|---|---|---|
| Work | AISI 4130 Brinell Hardness $H_B$:260 | AISI 4130 Brinell Hardness $H_B$:270 |
| Cutting speed (m/min.) | 60 | 80 |
| Feed (m/rev.) | 0.7 | 0.5 |
| Depth of cut (mm) | 10 | 3 |
| Cutting time (min.) | 10 | 3 |

EXAMPLE 4

An $Y_2O_3$ powder of 0.5 μm average particle size was prepared in addition to the powders as used in Example 1, and these powders were processed in compositions set forth in TABLE 8A in the same manner and conditions as in Example 1 to form cermets 26–30 and comparative cermets 6 and 7, which were substantially identical in compositions to their blends respectively.

These cermets were subjected to the same tests as in Example 1 except that the high speed continuous cutting test was conducted with a cutting speed of 210 m/min. and that the intermittent cutting test was carried out with a feed of 0.45 mm/revolution. The results are shown in TABLE 8B.

For comparison purposes, the conventional inserts 1 and the conventional inserts 2 as set forth in TABLE 3 were subjected to the above-described tests, the results of which are also given in TABLE 8B.

It is seen from TABLE 8 that all the cermets of the present invention were excellent in hardness and toughness and exhibited excellent wearing resistance and impact resistance in both the cutting tests. However, the comparative cermet 6, which does not contain aluminum oxide and yttrium oxide and which is inferior in toughness and oxidation resistance, was unable to perform cutting in 5 minutes in the high speed continuous cutting test since rapid grooving wear and crater wear occur due to oxidation, and since in the intermittent cutting test large chippings were produced in its edge due to insufficient toughness. With respect to the comparative cermet 7 which contains (Ti, W)C,N beyond the upper limit concentration of the present invention, large chippings were produced in most of its inserts in the intermittent cutting test due to inferior toughness or impact resistance although the inserts exhibited excellent wear resistance. It was further noted that the conventional inserts 1 and 2 were inferior in both wearing resistance and toughness.

TABLE 8A

| | | Blend Composition (% by weight) | | | |
|---|---|---|---|---|---|
| | | (Ti, W)C,N | $Al_2O_3$ | $Y_2O_3$ | W |
| Cermet of the Present Invention | 26 | 40.0 | 0.25 | 0.25 | 59.5 |
| | 27 | 40.0 | 0.5 | 0.5 | 59.0 |
| | 28 | 40.5 | 2.0 | 1.0 | 56.5 |
| | 29 | 41.0 | 3.0 | 2.0 | 54.0 |
| | 30 | 48.0 | 2.0 | 1.5 | 48.5 |
| Comparative Cermet | 6 | 40.0 | —* | —* | 60.0 |
| | 7 | 54.5* | 3.0 | 2.0 | 40.5 |
| Conventional Inserts | 1 | Cemented Tungsten Carbide Alloy (P 10) | | | |
| | 2 | Tic—10%Mo—15%Ni | | | |

*not fallen within the scope of the present invention

TABLE 8B

| | | Hardness ($H_RA$) | T.R.S. (kg/mm²) | High Speed Continuous Cutting: Width of Flank Wear (mm) | High Speed Continuous Cutting: Crater Depth (μm) | Intermittent Cutting: Number of Largely Chipped Tools/Number of Tested Tools |
|---|---|---|---|---|---|---|
| Cermet of the Present Invention | 26 | 91.4 | 92 | 0.17 | 0 | 3/10 |
| | 27 | 91.3 | 95 | 0.16 | 0 | 2/10 |
| | 28 | 91.1 | 109 | 0.17 | 40 | 1/10 |
| | 29 | 90.9 | 113 | 0.19 | 3 | 0/10 |
| | 30 | 91.6 | 84 | 0.13 | 30 | 3/10 |
| Comparative Cermet | 6 | 90.0 | 50 | Largely Chipped in 5 min. | | 9/10 |
| | 7 | 91.5 | 61 | 0.12 | 35 | 9/10 |
| Conventional Inserts | 1 | — | — | 0.55 | 155 | 9/10 |
| | 2 | — | — | 0.45 | 85 | 10/10 |

EXAMPLE 5

The $Y_2O_3$ powder as used in Example 4 was prepared other than the powders used in Example 2, in compositions given in TABLE 9A, and these powders were mixed and compacted on the same conditions as in Example 1 and then sintered in atmospheres indicated in TABLE 9A at 2000° C. for two hours to produce cermets 31–41 covered by the appended claims. These cermets 31–41 were substantially of the same compositions as their blends respectively.

The cermets 31–41 thus obtained and the conventional inserts 3 as used in Example 2 were subjected to the same tests as in the Example 2 on the same conditions except that the continuous cutting test under a large feed per revolution and the intermittent cutting test were carried out at a cutting speed of 110 m/min.

The results of the tests are given in TABLE 9B, from which it is seen that the cermets 31–41 of the present invention had excellent hardness and toughness and exhibited excellent cutting performances in both the continuous cutting test and the intermittent cutting test. However, it was noted that the conventional inserts 3 could not perform cutting in 2.5 min. in the continuous cutting test due to inferior plastic deformation resistance although they were equal in toughness or impact resistance to the cermets according to the present invention.

TABLE 9A

| | | Blended Composition (% by weight) | | | | | | | Atmosphere in Sintering |
|---|---|---|---|---|---|---|---|---|---|
| | | $(Ti_{0.75}W_{0.25})\cdot(C_{0.8}N_{0.2})$ | $(Ti_{0.85}W_{0.15})\cdot(C_{0.7}N_{0.3})$ | $(Ti_{0.7}W_{0.3})\cdot(C_{0.7}N_{0.3})$ | $(Ti_{0.8}W_{0.2})\cdot(C_{0.6}N_{0.4})$ | $Al_2O_3$ | $Y_2O_3$ | W | |
| Cermet of the Present Invention | 31 | 35.0 | — | — | — | 2.5 | 2.5 | 60.0 | Nitrogen Gas of 300 Torr |
| | 32 | — | 30.0 | — | — | 2.5 | 2.5 | 65.0 | Nitrogen Gas of 400 Torr |
| | 33 | — | — | 35.0 | — | 2.5 | 2.5 | 60.0 | Nitrogen Gas of 500 Torr |
| | 34 | — | — | — | 30.0 | 1.5 | 1.5 | 67.0 | Nitrogen Gas of 600 Torr |
| | 35 | 17.5 | — | — | 15.0 | 2.5 | 2.5 | 62.5 | Vacuum of $1 \times 10^{-2}$ Torr |
| | 36 | — | 15.0 | 17.5 | — | 2.5 | 2.5 | 62.5 | |
| | 37 | 30.0 | — | — | — | 2.5 | 2.0 | 65.5 | Argon Gas of 400 Torr |
| | 38 | — | 27.5 | — | — | 2.5 | 2.0 | 68.0 | |
| | 39 | — | — | 30.0 | — | 2.5 | 2.0 | 65.5 | |
| | 40 | — | — | — | 27.5 | 1.5 | 1.0 | 69.5 | |
| | 41 | 15.0 | — | — | 15.0 | 2.5 | 2.0 | 65.5 | Vacuum of $1 \times 10^{-2}$ Torr |
| Conventional insert | 3 | Cemented Tungsten Carbide Alloy (P 30) | | | | | | | — |

TABLE 9B

| | | Hardness ($H_RA$) | T.R.S. ($kg/mm^2$) | High Feed Continuous Cutting: Width of Flank Wear (mm) | High Feed Continuous Cutting: Crater Depth (um) | Intermittent Cutting: Number of Largely Chipped Tools/Number of Tested Tools |
|---|---|---|---|---|---|---|
| Cermet of the Present Invention | 31 | 90.0 | 120 | 0.17 | 45 | 2/10 |
| | 32 | 89.8 | 122 | 0.15 | 40 | 1/10 |
| | 33 | 89.9 | 122 | 0.15 | 45 | 0/10 |
| | 34 | 89.7 | 119 | 0.19 | 35 | 2/10 |
| | 35 | 90.0 | 120 | 0.18 | 40 | 2/10 |
| | 36 | 90.0 | 122 | 0.15 | 40 | 1/10 |
| | 37 | 89.9 | 124 | 0.19 | 50 | 1/10 |
| | 38 | 89.8 | 124 | 0.18 | 50 | 1/10 |
| | 39 | 89.6 | 125 | 0.18 | 50 | 0/10 |
| | 40 | 89.6 | 117 | 0.20 | 50 | 2/10 |
| | 41 | 89.8 | 118 | 0.19 | 50 | 2/10 |
| Conventional insert | 3 | — | — | Plastic Deformation in 2.5 min. | | 3/10 |

EXAMPLE 6

The $Y_2O_3$ powder as described in Example 4 was prepared in addition to the powders as described in Example 3, and these powders were processed in compositions given in TABLE 10A in the same manner and conditions as in Example 3 to produce cermets 42–50 fallen within the scope of the present invention and comparative cermets 8–10, all these cermets being substantially of the same compositions as their blends respectively.

The cermets 42–50, the comparative cermets 8–10 and conventional inserts 4 as defined in Example 3 were subjected to the same tests as in Example 3 on the same conditions except that the continuous cutting test under large feed per revolution was conducted at a cutting speed of 70 m/min. and that the intermittent cutting test was conducted at a cutting speed of 90 m/min.

The results of the tests are given in TABLE 10B, from which it is seen that the cermets 42–50 of the present invention had excellent hardness and toughness and exhibited excellent cutting performances in both the continuous cutting test and the intermittent cutting test. Further, it is clear from the results of the tests on the cermets 47–50 that not larger than about 1% of impurities, such as Mo, Ni, Co or Re, produced little influence on the properties of those cermets. In contrast, the lack of toughness and poor cutting performance were noted in the comparative cermet 8 which contains $Al_2O_3$ and $Y_2O_3$ beyond the upper limit concentrations of the present invention, the comparative cermet 9 which contains (Ti, W)C,N below the lower limit concentration of the present invention and the comparative cermet 10 which contains more than about 1% of Ni as an impurity. With respect to the conventional inserts 4, it was noted that in the continuous cutting test they could not perform cutting in 0.4 min. due to inferior plastic deformation resistance although they exhibited excellent toughness or impact resistance to the same degree as the cermets 42–50 according to the present invention.

TABLE 10A

| | | Blend Composition (% by weight) | | | | | Sintering Temperature (°C.) |
|---|---|---|---|---|---|---|---|
| | | $(Ti_{0.8}W_{0.2})\cdot(C_{0.7}N_{0.3})$ | $Al_2O_3$ | $Y_2O_3$ | W | Impurity | |
| Cermet of the Present Invention | 42 | 30.0 | 2.5 | 2.5 | 65.0 | — | 2000 |
| | 43 | 25.0 | 3.0 | 2.5 | 69.5 | — | 2000 |
| | 44 | 20.0 | 4.0 | 3.0 | 73.0 | — | 2000 |
| | 45 | 15.0 | 4.5 | 3.5 | 77.0 | — | 2200 |
| | 46 | 10.0 | 5.0 | 4.5 | 80.5 | — | 2200 |
| | 47 | 25.0 | 2.5 | 2.5 | 69.0 | Mo:1.0 | 2000 |
| | 48 | 25.0 | 2.5 | 2.5 | 69.2 | Ni:0.8 | 2000 |
| | 49 | 25.0 | 2.5 | 2.5 | 69.3 | Co:0.7 | 2000 |

TABLE 10A-continued

| | | Blend Composition (% by weight) | | | | | Sintering Temperature (°C.) |
|---|---|---|---|---|---|---|---|
| | | $(Ti_{0.8}W_{0.2})\cdot(C_{0.7}N_{0.3})$ | $Al_2O_3$ | $Y_2O_3$ | W | Impurity | |
| | 50 | 25.0 | 2.5 | 2.5 | 69.5 | Re:0.5 | 2000 |
| Comparative Cermet | 8 | 10.0 | 6.0* | 5.5* | 78.5 | — | 2200 |
| | 9 | 8.5* | 2.5 | 2.5 | 86.5 | — | 2200 |
| | 10 | 25.0 | 2.5 | 2.5 | 67.5 | Ni:5* | 1800 |
| Conventional Inserts | 4 | Cemented Tungsten Carbide Alloy (P 40) | | | | | — |

*not fallen within the scope of the present invention

TABLE 10B

| | | Hardness ($H_RA$) | T.R.S. ($kg/mm^2$) | High Feed Continuous Cutting: Width of Flank Wear (mm) | High Feed Continuous Cutting: Crater Depth (μm) | Intermittent Cutting: Number of Largely Chipped Tools/Number of Tested Tools |
|---|---|---|---|---|---|---|
| Cermet of the Present Invention | 42 | 88.8 | 122 | 0.17 | 35 | 1/10 |
| | 43 | 88.6 | 123 | 0.18 | 40 | 1/10 |
| | 44 | 88.5 | 124 | 0.19 | 40 | 1/10 |
| | 45 | 88.2 | 124 | 0.22 | 35 | 2/10 |
| | 46 | 87.7 | 113 | 0.28 | 50 | 3/10 |
| | 47 | 88.3 | 111 | 0.21 | 50 | 3/10 |
| | 48 | 88.1 | 117 | 0.22 | 55 | 2/10 |
| | 49 | 88.1 | 115 | 0.22 | 55 | 2/10 |
| | 50 | 88.4 | 122 | 0.20 | 45 | 1/10 |
| Comparative | 8 | 87.5 | 59 | Plastic Deformation in 1.8 min. | | 9/10 |
| | 9 | 86.9 | 55 | Plastic Deformation in 1.4 min. | | 9/10 |
| Cermet | 10 | 87.0 | 65 | Plastic Deformation in 0.8 min. | | 10/10 |
| Conventional Inserts | 4 | — | — | Plastic Deformation in 0.4 min. | | 2/10 |

TABLE 11

| Coated Insert | Composition of Substrate | Coating Layer: Composition | Coating Layer: A.T.*3 (μm) | High Speed Continuous Cutting: Flank Wear Width (mm) | High Speed Continuous Cutting: Crater Depth (μm) | Intermittent Cutting: Number of Largely Chipped Tools/Number of Tested Tools |
|---|---|---|---|---|---|---|
| 1 | $(Ti_{0.85}W_{0.15})(C_{0.7}N_{0.3})$: 30.0<br>$Al_2O_3$: 5.0<br>W: 65.0 | $TiC_{0.7}N_{0.3}$*2 | 6 | 0.08 | 20 | 2/10 |
| 2 | | T: $Al_2O_3$<br>B: $TiC_{0.5}N_{0.5}$ | 2<br>4 | 0.10 | 10 | 3/10 |
| 3*1 | | T: $Al_2O_3$<br>I: $TiC_{0.5}O_{0.5}$<br>B: $TiC_{0.8}N_{0.2}$ | 1<br>1<br>4 | 0.09 | 15 | 2/10 |
| 4 | $(Ti_{0.8}W_{0.2})(C_{0.6}N_{0.4})$: 30.0<br>$Al_2O_3$: 3.0<br>W: 67.0 | TiN | 7 | 0.13 | 30 | 1/10 |
| 5 | $(Ti_{0.8}W_{0.2})(C_{0.6}N_{0.4})$: 30.0 | T: $AlO_{0.7}N_{0.3}$<br>B: HfN | 2<br>4 | 0.11 | 20 | 3/10 |
| 6 | $Al_2O_3$: 3.0<br>W: 67.0 | T: ZrC<br>I: $Al_2O_3$<br>B: $TiC_{0.6}N_{0.4}$ | 2<br>2<br>3 | 0.09 | 15 | 3/10 |
| 7 | $(Ti_{0.8}W_{0.2})(C_{0.7}N_{0.3})$: 20.0<br>$Al_2O_3$: 7.0 | T: $TiC_{0.2}N_{0.8}O_{0.2}$<br>B: $Al_2O_3$ | 3<br>3 | 0.12 | 10 | 3/10 |
| 8 | W: 73.0 | T: HfC<br>I: $Al_2O_3$<br>B: $TiC_{0.7}N_{0.3}$ | 1<br>2<br>4 | 0.11 | 10 | 2/10 |
| 9 | | T: $ZrC_{0.6}N_{0.4}$<br>B: $TiC_{0.6}N_{0.4}$ | 2<br>5 | 0.10 | 25 | 3/10 |
| 10 | | $TiC_{0.6}N_{0.4}$ | 6 | 0.08 | 25 | 1/10 |
| 11 | $(Ti_{0.85}W_{0.15})(C_{0.7}N_{0.3})$: 30.0<br>$Al_2O_3$: 2.5 | T: $Al_2O_3$<br>B: $TiC_{0.6}N_{0.4}$ | 2<br>4 | 0.10 | 15 | 2/10 |
| 12 | $Y_2O_3$: 2.5<br>W: 65 | T: $Al_2O_3$<br>I: | 1 | | | |

TABLE 11-continued

| Coated Insert | Composition of Substrate | Coating Layer Composition | Coating Layer A.T.*3 (μm) | High Speed Continuous Cutting Flank Wear Width (mm) | High Speed Continuous Cutting Crater Depth (μm) | Intermittent Cutting Number of Largely Chipped Tools/ Number of Tested Tools |
|---|---|---|---|---|---|---|
| | | $TiC_{0.3}N_{0.4}O_{0.3}$ | 1 | 0.09 | 20 | 2/10 |
| | | B: $TiC_{0.7}N_{0.3}$ | 4 | | | |
| 13 | $(Ti_{0.8}W_{0.2})(C_{0.6}N_{0.4})$: 30.0 | TiN | 7 | 0.14 | 30 | 1/10 |
| | $Al_2O_3$: 1.5 | | | | | |
| 14 | $Y_2O_3$: 1.5 | T: $AlO_{0.6}N_{0.4}$ | 2 | 0.10 | 20 | 3/10 |
| | W: 67.0 | B: $HfC_{0.2}N_{0.8}$ | 4 | | | |
| 15 | | T: TiC | 3 | | | |
| | | I: $Al_2O_3$ | 2 | 0.09 | 20 | 2/10 |
| | | B: $TiC_{0.6}N_{0.4}$ | 2 | | | |
| 16 | $(Ti_{0.8}W_{0.2})(C_{0.7}N_{0.3})$: 20.0 | $TiC_{0.7}N_{0.3}$ | 6 | 0.11 | 25 | 1/10 |
| | $Al_2O_3$: 4.0 | | | | | |
| 17 | $Y_2O_3$: 3.0 | T: TiN | 1 | | | |
| | W: 73.0 | I: $Al_2O_3$ | 2 | 0.12 | 15 | 1/10 |
| | | B: $TiC_{0.7}N_{0.3}$ | 4 | | | |
| 18 | | T: $ZrC_{0.5}N_{0.5}$ | 2 | 0.10 | 30 | 3/10 |
| | | B: $TiC_{0.6}N_{0.4}$ | 5 | | | |

*1The substrate of insert No. 3 contains 30.0 wt. % of $(Ti_{0.85}W_{0.15})(C_{0.7}N_{0.3})$, 5.0 wt. % of $Al_2O_3$ and 65.0 wt. % of W, and the coating thereof consists of an $Al_2O_3$ top layer (T) of 1 μm thickness, a $TiC_{0.5}O_{0.5}$ intermediate layer (T) of 1 μm thickness and a $TiC_{0.8}N_{0.2}$ bottom layer (B) of 4 μm thickness.
*2 0.7 and 0.3 represent the atomic ratios of C and N respectively.
*3 The A.T. stands for average thickness.

EXAMPLE 7

Cutting tool inserts were prepared by machining the cermets 7, 9, 19, 32, 34 and 44 of the present invention into a standard SNG 433 shape, and were coated by conventional chemical vapour deposition to form one or more surface coating layers to thereby produce coated inserts 1–18. The compositions and average thickness of the coated layers are given in TABLE 11. Cutting tests were made on these inserts on the same conditions as in Example 1. The results are also set forth in TABLE 11, from which it is seen that all the inserts fallen within the scope of the present invention exhibited excellent wear resistance in both of the cutting tests.

EXAMPLE 8

Cutting tool inserts were prepared by machining the cermets 14 and 39 of the present invention into a standard SNG 432 shape, and were coated by conventional physical vapour deposition to form one or more surface coating layers to thereby produce coated inserts 19–28. The compositions and average thickness of the coated layers are given in TABLE 12. Cutting tests were carried out on these inserts on the same conditions as in Example 2. The results are also set forth in TABLE 12, from which it is seen that the inserts 19–28, which are fallen within the scope of the present invention, exhibited excellent wear resistance in both of the cutting tests.

TABLE 12

| Coated Insert | Composition of Substrate (wt. %) | Coating Layer Composition | Coating Layer A.T.*3 (μm) | High Speed Continuous Cutting Flank Wear Width (mm) | High Speed Continuous Cutting Crater Depth (μm) | Intermittent Cutting Number of Largely Chipped Tools/ Number of Tested Tools |
|---|---|---|---|---|---|---|
| 19 | $(Ti_{0.7}W_{0.3})(C_{0.7}N_{0.3})$: 30.0 | TiN | 3 | 0.13 | 20 | 0/10 |
| 20 | $Al_2O_3$: 4.5 | TiC | 3 | 0.10 | 30 | 2/10 |
| | W: 65.5 | | | | | |
| 21 | | $TiC_{0.5}N_{0.5}$ | 3 | 0.11 | 25 | 1/10 |
| 22 | | T: TiC | 1 | 0.10 | 25 | 1/10 |
| | | B: TiN | 2 | | | |
| 23*4 | | T: TiC | 1 | | | |
| | | I: TiN | 1 | | | |
| | | I: TiC | 1 | 0.09 | 20 | 1/10 |
| | | B: TiN | 2 | | | |
| 24 | $(Ti_{0.7}W_{0.3})(C_{0.7}N_{0.3})$: 30.0 | TiN | 4 | 0.13 | 20 | 1/10 |
| 25 | $Al_2O_3$: 2.5 | TiC | 3 | 0.11 | 30 | 2/10 |
| | $Y_2O_3$: 2.0 | | | | | |
| 26 | W: 65.5 | $TiC_{0.4}N_{0.6}$ | 4 | 0.10 | 25 | 1/10 |
| 27 | | T: TiC | 2 | 0.10 | 30 | 1/10 |
| | | B: TiN | 2 | | | |
| 28 | | T: TiN | 1 | | | |
| | | I: TiC | 1 | 0.11 | 20 | 0/10 |
| | | B: TiN | 2 | | | |

*4The substrate of insert No. 23 was coated with a TiN bottom layer, a TiC intermediate layer, a TiN intermediate layer and TiC top layer, which were superposed in the described order.

What is claimed is:

1. A tungsten cermet for use in cutting tools, including a carbonitride having titanium and tungsten, the cermet consisting essentially of, about 10 to about 50% by weight of the carbonitride, about 0.5 to about 10% by weight of aluminum oxide, not more than about 1% by weight of inevitable impurities, balance tungsten.

2. A tungsten cermet as recited in claim 1 wherein the cermet contains about 25 to about 45% by weight of the carbonitride and about 3 to about 7% by weight of aluminum oxide.

3. A tungsten cermet as recited in claim 1 wherein the cermet contains about 0.25 to about 5% by weight of aluminum oxide and further contains about 0.25 to about 5% by weight of yttrium oxide.

4. A tungsten cermet as recited in claim 3 wherein the cermet contains about 25 to about 45% by weight of the carbonitride, about 2 to about 3.5% by weight of aluminum oxide and about 1.5 to about 3% by weight of yttrium oxide.

5. A blade member for cutting tools, machined from the tungsten cermet as recited in claim 1, wherein the blade member is coated with at least one layer composed of one substance selected from the group consisting of an oxide and an oxynitride of aluminum; a carbide, a nitride, a carbonitride and an oxycarbonitride of titanium; a carbide, a nitride, a carbonitride and an oxycarbonitride of zirconium; and a carbide, a nitride, a carbonitride and an oxycarbonitride of hafnium.

6. A blade member as recited in claim 5 wherein the thickness of the coating layer is within a range of about 0.5 to about 20 μm.

7. A blade member for cutting tools, machined from the tungsten cermet as recited in claim 2 wherein the blade member is coated with at least one layer composed of one substance selected from the group consisting of an oxide and an oxynitride of aluminum; a carbide, a nitride, a carbonitride and an oxycarbonitride of titanium; a carbide, a nitride, a carbonitride and an oxycarbonitride of zirconium; and a carbide, a nitride, a carbonitride and an oxycarbonitride of hafnium.

8. A blade member for cutting tools, machined from the tungsten cermet as recited in claim 3 wherein the blade member is coated with at least one layer composed of one substance selected from the group consisting of an oxide and an oxynitride of aluminum; a carbide, a nitride, a carbonitride and an oxycarbonitride of titanium; a carbide, a nitride, a carbonitride and an oxycarbonitride of zirconium; and a carbide, a nitride, a carbonitride and an oxycarbonitride of hafnium.

9. A blade member for cutting tools, machined from the tungsten cermet as recited in claim 4 wherein the blade member is coated with at least one layer composed of one substance selected from the group consisting of an oxide and an oxynitride of aluminum; a carbide, a nitride, a carbonitride and an oxycarbonitride of titanium; a carbide, a nitride, a carbonitride and an oxycarbonitride of zirconium; and a carbide, a nitride, a carbonitride and an oxycarbonitride of hafnium.

10. A blade member as recited in claim 7 wherein the thickness of the coating layer is within a range of about 0.5 to about 20 μm.

11. A blade member as recited in claim 8 wherein the thickness of the coating layer is within a range of about 0.5 to about 20 μm.

12. A blade member as recited in claim 9 wherein the thickness of the coating layer is within a range of about 0.5 to about 20 μm.

* * * * *